US005184697A

United States Patent [19]

Crewe et al.

[11] Patent Number: 5,184,697

[45] Date of Patent: Feb. 9, 1993

[54] LOCKING SWIVEL FOR ROTATABLY CONNECTING TWO COMPONENTS

[75] Inventors: F. Coates Crewe, 1331 Hagood Ave., Columbia, S.C. 29205; James E. Thomas, Lexington, N.C.

[73] Assignee: F. Coates Crewe, Columbia, S.C.

[21] Appl. No.: 760,914

[22] Filed: Sep. 17, 1991

Related U.S. Application Data

[63] Continuation of Ser. No. 742,766, Aug. 9, 1991.

[51] Int. Cl.[5] ..... B27B 21/00; B25H 1/06

[52] U.S. Cl. ..... 182/153; 182/225

[58] Field of Search ..... 182/153, 181–185, 182/225

[56] References Cited

U.S. PATENT DOCUMENTS

| | | | |
|---|---|---|---|
| 4,278,148 | 7/1981 | Daley | 182/181 |
| 4,508,194 | 4/1985 | Freewalt | 182/153 |
| 4,754,844 | 7/1988 | Sutton | 182/155 |

OTHER PUBLICATIONS

Protest papers filed May 15, 1992.

*Primary Examiner*—Carl D. Friedman

*Attorney, Agent, or Firm*—Pollock, Vande Sande & Priddy

[57] ABSTRACT

A sawhorse comprising an elongated cross beam for supporting a workpiece, and two leg assemblies each attached to the cross beam by a swivel assembly providing pivotal movement of the corresponding leg assembly between a support position with the leg assembly transverse to the beam and a folded position with the leg assembly aligned with the beam. The swivel assembly includes a foot member nested in a shoe member and these members have cooperating detents and recesses for locking the leg assembly in its respective positions. The nested members are biased toward each other into their locking relationship and are retractable relative to each other for pivotal movement of the leg assembly.

23 Claims, 7 Drawing Sheets

LOCKING SWIVEL FOR ROTATABLY CONNECTING TWO COMPONENTS

RELATED APPLICATIONS

This is a continuation of U.S. application Ser. No. 07/742,766 filed Aug. 9, 1991, the contents of which are incorporated herein by reference.

TECHNICAL FIELD

The present invention relates to a work support of the sawhorse type having an elongated beam and preferably at least two longitudinally spaced supporting legs or equivalent support structures.

BACKGROUND OF THE INVENTION

Work supports of the type commonly referred to as sawhorses provide a waist high work station on which may be performed any number of tasks, primarily woodworking. Conventional sawhorses generally have a wooden cross beam supported by two pairs of downwardly diverging legs, each pair extending downward in a vertically and horizontally supporting relationship. The structure of the conventional sawhorse is such that it must be stored in a rigid and bulky state, which requires substantially more space than if the sawhorse were disassembled or folded.

The storage space required can be reduced greatly where the sawhorse structure is easily folded or disassembled. A sawhorse structure of this type is disclosed in U.S. Pat. No. 4,754,844. In this patent, the legs in supporting relationship can be folded under the connecting cross beam to create a relatively compact structure for storage. U.S. Pat. No. 4,508,194 shows a collapsible sawhorse where the legs are rotated into a parallel relationship with the connecting cross beam, thereby reducing the width of the sawhorse for storage. However, the sawhorse structures of these patents are heavy, expensive to manufacture, complicated to operate, and difficult to maintain in a readily operable condition.

A desirable feature of any work support structure that is capable of being broken into smaller components or reduced in size is the speed and ease with which it can be assembled and disassembled. A sawhorse that requires nails or bolts to be removed or installed will frequently be stored in its rigid configuration because of the inconvenience of its disassembly, whereas a sawhorse that is easily reduced in size will be more often stored in its smaller configuration. In addition, the more steps required to place a sawhorse in a storage condition, the less likely this feature will be used.

SUMMARY OF THE INVENTION

A principal object of the present invention is to overcome the foregoing deficiencies of the prior art by providing a relatively light weight sawhorse having a sturdy work support structure that can be easily folded into a compact structure and stored in a small space. Further, with the sawhorse of the present invention, no tools are required for folding the structure, and the procedures to place the structure in a folded condition are not complicated. Merely pivoting the two leg assemblies through 90 degrees into their folded positions makes the sawhorse substantially thin and long as the cross beam connecting the leg assemblies. The height of the sawhorse structure remains the same in both its work support and its folded conditions.

The folding of the sawhorse is accomplished by a swivel assembly which connects each of two A-frame leg assemblies to a connecting cross beam which provides the work support surface. The two leg assemblies, in relation to the cross beam, can be rotated through 360 degrees and independently of each other. Each swivel assembly has two hollow members which are nested one in the other and are biased toward one another using a spring and fastener assembly. By simply separating slightly the two members of the swivel assembly against the spring tension, the leg assemblies can each be rotated 90 degrees to change the sawhorse back and forth between its support and folded conditions. The leg assemblies are locked in their respective support and folded positions by detent means comprising ridges and grooves provided respectively on the two nested members of each swivel assembly.

BRIEF DESCRIPTION OF THE DRAWINGS

A better understanding of the invention and its advantages may be obtained from the detailed description given below of the preferred embodiments taken in conjunction with the accompanying drawings in which.

DETAILED DESCRIPTION OF THE INVENTION

Figure 1:
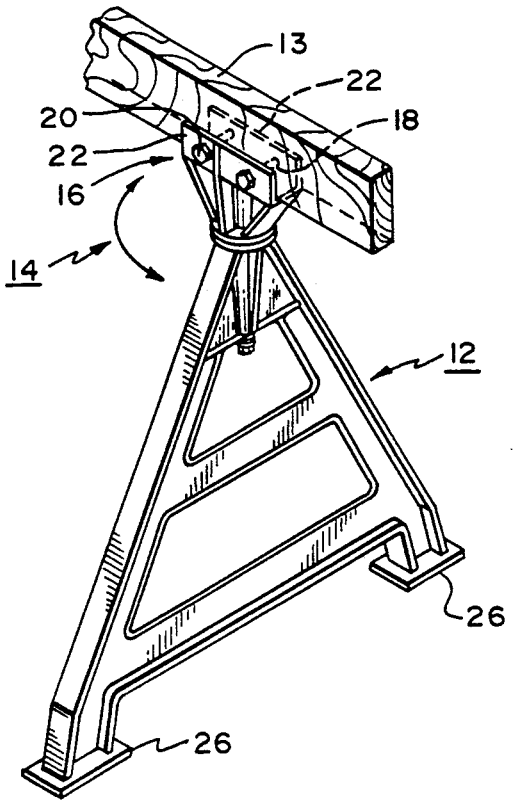
FIG. 1 is a perspective view of one end of a sawhorse employing the present invention.
Figure 2:
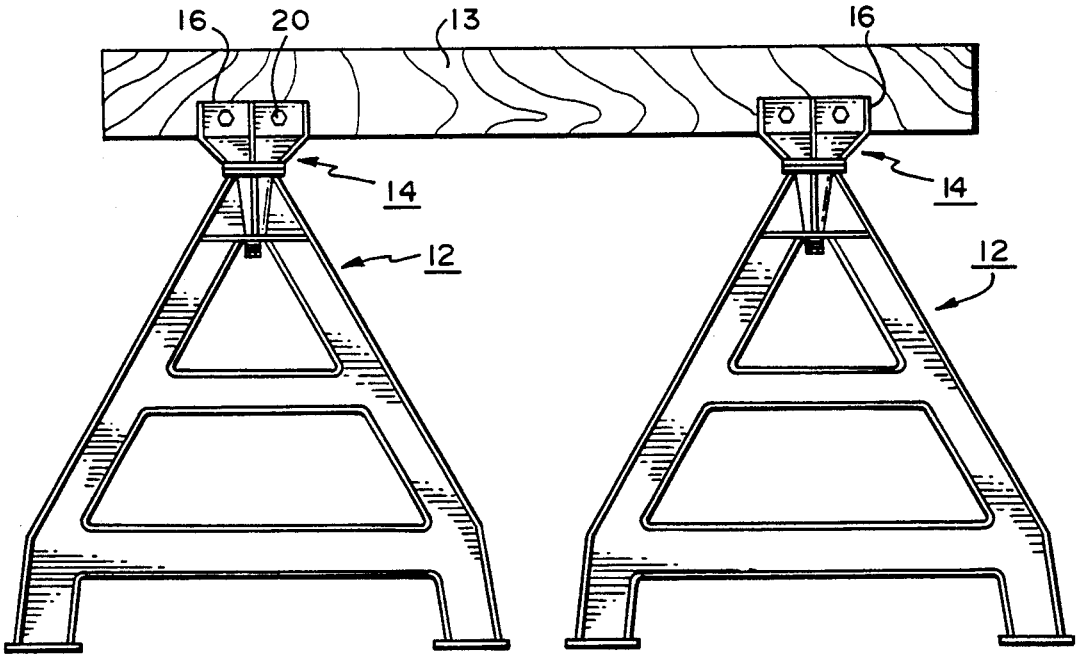
FIG. 2 is a side elevation of the complete sawhorse as it would appear in its folded or stored condition.

A preferred embodiment of the sawhorse of the present invention is illustrated in FIGS. 1–4 of the drawings. An A-frame leg assembly 12 is connected to a cross beam 13 of the sawhorse by a swivel assembly, generally designated 14. Securing the cross beam 13 to the swivel assembly 14 is a U-shaped bracket 16 with apertures 18 for receiving bolts 20 to secure the cross beam 13 and U-shaped bracket 16 together. As shown in FIG. 2, the sawhorse of the present invention may have both of its leg assemblies 12,12 rotated into a folded position for storage. The two A-frame leg assemblies 12,12 are connected by the cross beam 13 and, as shown, may be rotated into a substantially parallel relationship with cross beam 13 for storage.

Cross beam 13 of the present invention preferably has a length anywhere in the range from about 2 to about 10 feet., but more preferably will have a length in the range of about 3 to 4 feet. However, cross beam 13 may have any length necessary for a specific task and may be provided with more than two leg assemblies. In addition, the cross beam 13 is preferably a 2×4 but may have any cross-sectional dimensions and shape suitable for a particular task. Accordingly, the U-shaped bracket 16 can be adapted to receive any width or cross-sectional shape of the cross beam and therefore is not itself restricted to any specific width or cross-sectional shape.

Figure 4:
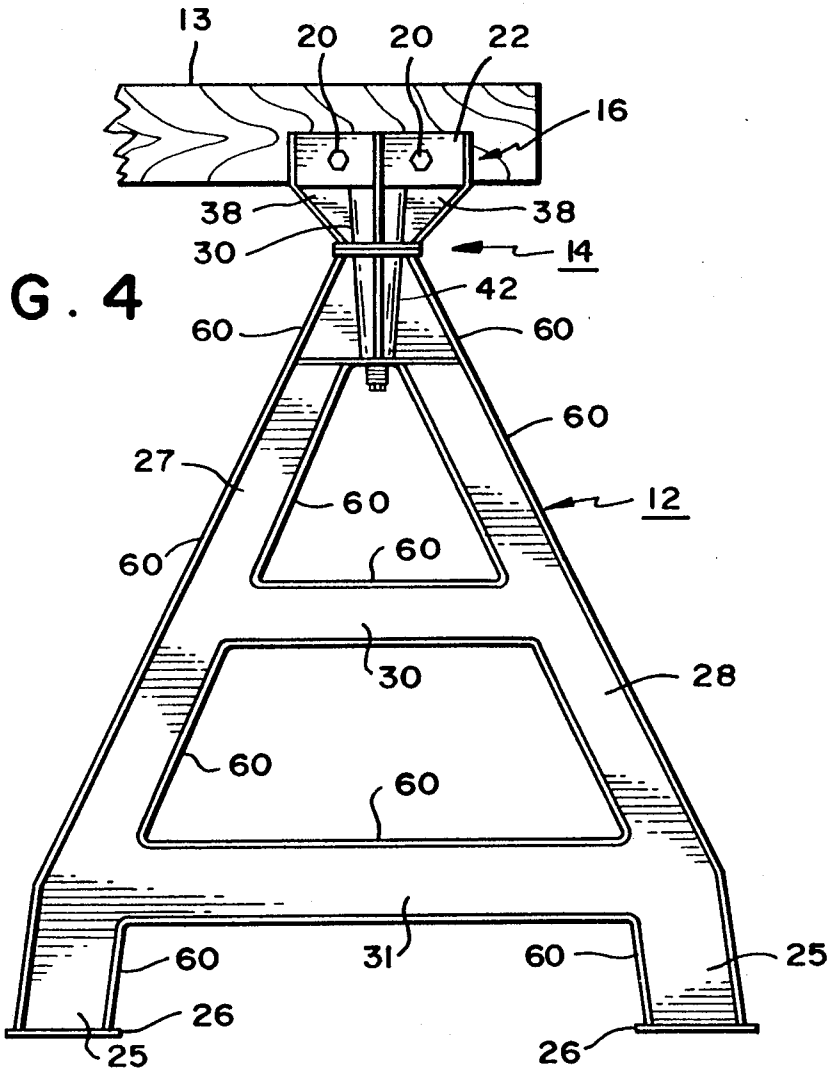
FIG. 4 is a side elevation of one leg assembly of the present invention the folded position.
Figure 3:
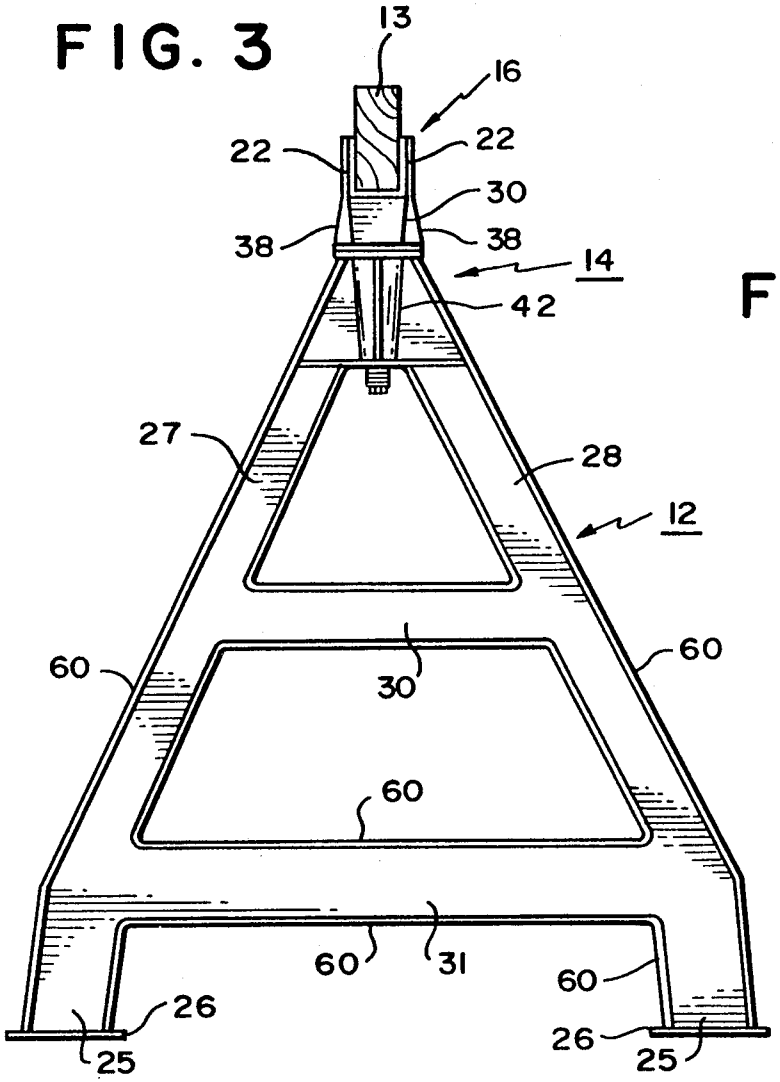
FIG. 3 is an end view in elevation of the sawhorse with its legs in their support position.

FIGS. 3 and 4 show a portion of the sawhorse of the present invention as it would appear in elevation both in its work supporting condition, as shown in FIG. 3, and in its folded or stored condition, as shown in FIG. 4. As shown in both FIGS. 3 and 4, leg assemblies 12,12 each comprise two vertically extending and downwardly flared struts 27 and 28 in combination with an upper horizontal brace 30 and a lower horizontal brace 31 for connecting the two downwardly diverging struts 27 and 28 together. Alternatively, there could be a solid, single piece leg structure (not shown) whereby each of the leg assemblies 12,12 would have the appearance of a solid triangle, with or without a pair of depending leg segments at the bottom edge thereof. These alternative embodiments are not preferred because they would add weight to the sawhorse assembly.

The horizontal braces and vertically extending struts add stability to the A-frame leg assemblies 12,12 of the sawhorse. In addition, the lower brace may be enlarged or contain a chamber (not shown) for ballast to add additional weight to lower the center of gravity of the sawhorse, depending on the stability required for given applications. Both the upper and lower braces also may be used as a shelf for items other than those merely used for their weight.

The lower ends of the depending leg segments 25,25 are preferably provided with stability pads or shoes 26 to distribute the weight applied to the sawhorse by supported workpieces. This feature is most beneficial when the sawhorse is set up on soft or unstable ground. Further, cloth or non-scuff material may be placed on the bottom of the pads 26 if the sawhorse is to be used on the finished surface of a floor susceptible to scuffing or scratching.

The structural details of each swivel assembly 14 are shown best in FIGS. 5–8. Cross beam 13 is secured within each U-shaped bracket 16, using bolts or screws 20 which pass through aligned apertures 18,18 in opposing sides 22,22 of bracket 16 (FIGS. 1 and 3), in order to connect swivel assemblies 14,14 to the cross beam. The U-shaped bracket 16 is preferably used to provide increased stability to the cross beam 13 because the sides 22,22 provide lateral support to the cross beam 13 and a sturdy fastening means to securely attach cross beam 13 to each swivel assembly. However, a flat plate (not shown) on the underside of the cross beam and having apertures extending parallel to the axis of the swivel assembly 14 could be used in place of bracket 16, but would not have these advantages.

The U-shaped bracket 16 is connected to a hollow conical foot 30 which extends down to a cylindrical neck 32 and has a wall 29 defining an interior chamber 31. Positioned part way along conical foot 30 is a peripheral ridge 36 which is structurally connected to the U-shaped bracket 16 by reinforcing webs 38. Preferably, the conical foot 30 is connected to the U-shaped bracket 16 not only by the webs 38 but also by welding or integrally molding these parts together as a single piece. In other words, foot 30, bracket 16, ridge 36, webs 38 and the additional foot parts mentioned below are preferably molded from a synthetic plastic material, such as polyethylene, polystyrene or polypropylene, which is preferably reinforced by fiberglass, carbon fibers or some other fibrous reinforcing material.

The conical foot 30 is provided with elongated locking ridges or detents 40 which may be aligned with and received in elongated recesses or grooves 44 having a corresponding shape and located along the side of a conical interior chamber 41 of a hollow shoe portion 42 of the A-frame leg assemblies 12,12. Shoe portion 42 is connected to struts 27 and 28 and to an upper end cross brace 52 by webs 43 which are similar to the webs 38 of foot 30. The cylindrical neck 32 at the converging lower end of conical foot 30 is sized and shaped to fit within and be guided by an aperture 45 positioned at the bottom of the interior chamber 41 of hollow conical shoe portion 42, which is preferably molded as part of the upper portion of the single piece leg assembly 12. The neck 32 has a central bore 33 which is preferably threaded for receiving a bolt or screw 46 for holding a spring 47 in position between a washer 50 and a spring deck 56 on the underside of the cross brace 52. In combination, the deck, spring, screw and neck provide a biasing means to retractably hold the detents 40 of conical foot 30 firmly in the recesses 44 of conical shoe 42.

Figure 6:
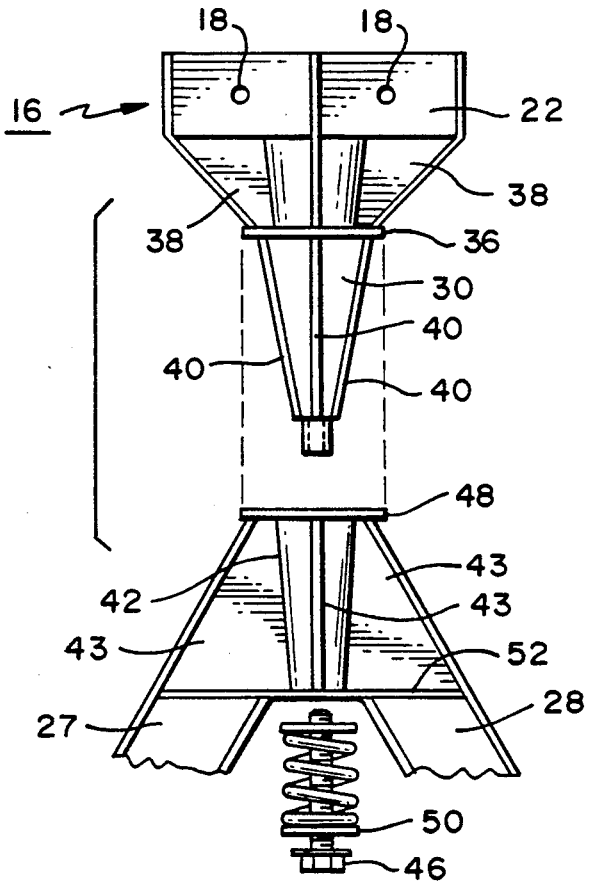
FIG. 6 is an enlarged fragmentary view of the swivel assembly shown in FIG.5.
Figure 5:
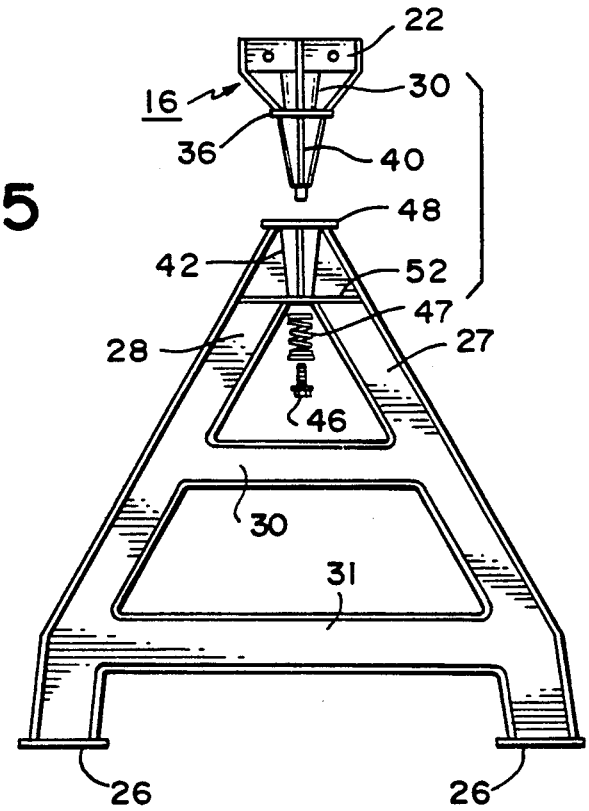
FIG. 5 is an exploded view in side elevation of the components of the swivel assembly of one of the leg assemblies of the present invention.
Figure 7:
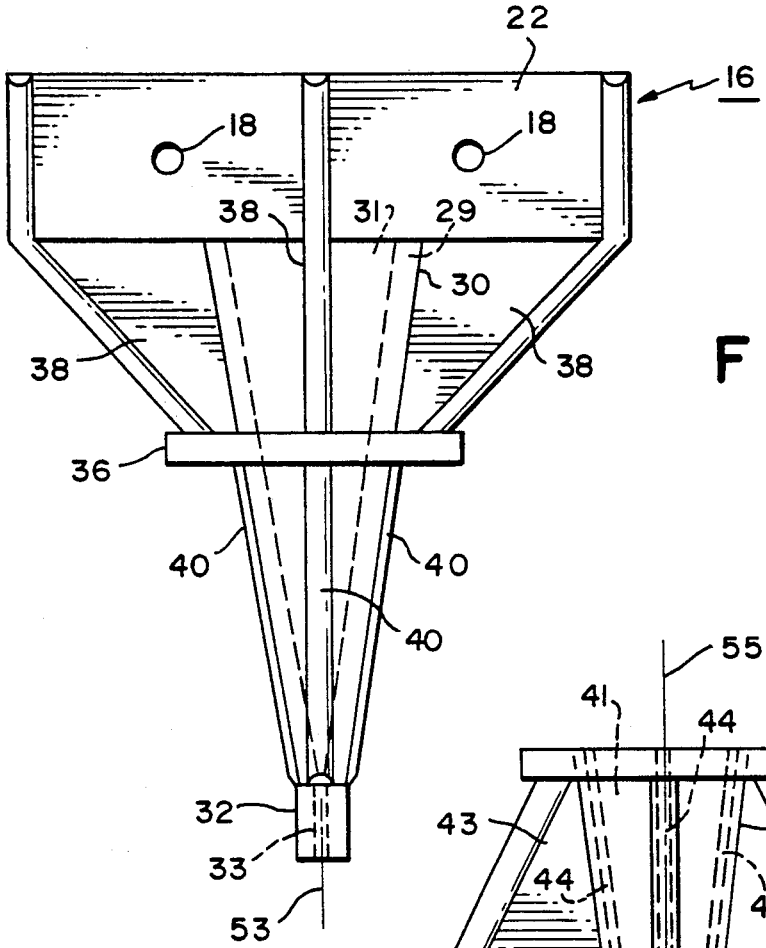
FIG. 7 is an enlarged view of the hollow foot member and mounting bracket of the swivel assembly of FIG. 5.

As shown in FIG. 6, the peripheral ridge 36 will be biased towards and rest on a platform 48 around the upper lip of conical shoe 42 when the foot and shoe are in interlocking relationship with the ridges and grooves intermeshed. The biasing means, preferably coil spring 47, will also act to hold peripheral ridge 36 in contact with platform 48. One end of the spring 47 contacts the underside of the spring deck 56 of the uppermost cross flange 52, and the other end of the spring 47 is held in position and connected to the neck 32 of conical foot 30 by the screw 46 and washer 50. This configuration of the swivel assembly 14 permits the A-frame leg assembly 12 to be moved slightly away from the cross beam 13, along an axis of rotation defined by common axes 53 and 55 of the nested foot 30 and the shoe 42, respectively, for an axial distance sufficient for the detents 40 of the conical foot 30 to be retracted out of the recesses 44 in the conical shoe 42, but insufficient for neck 32 to be retracted out of guide aperture 45. This retraction permits the A-frame leg assembly 12 to pivot between a locked support position perpendicular to the cross beam 13 (FIG. 1) and a locked folded position parallel to the cross beam 13 (FIG. 2).

Figure 8:
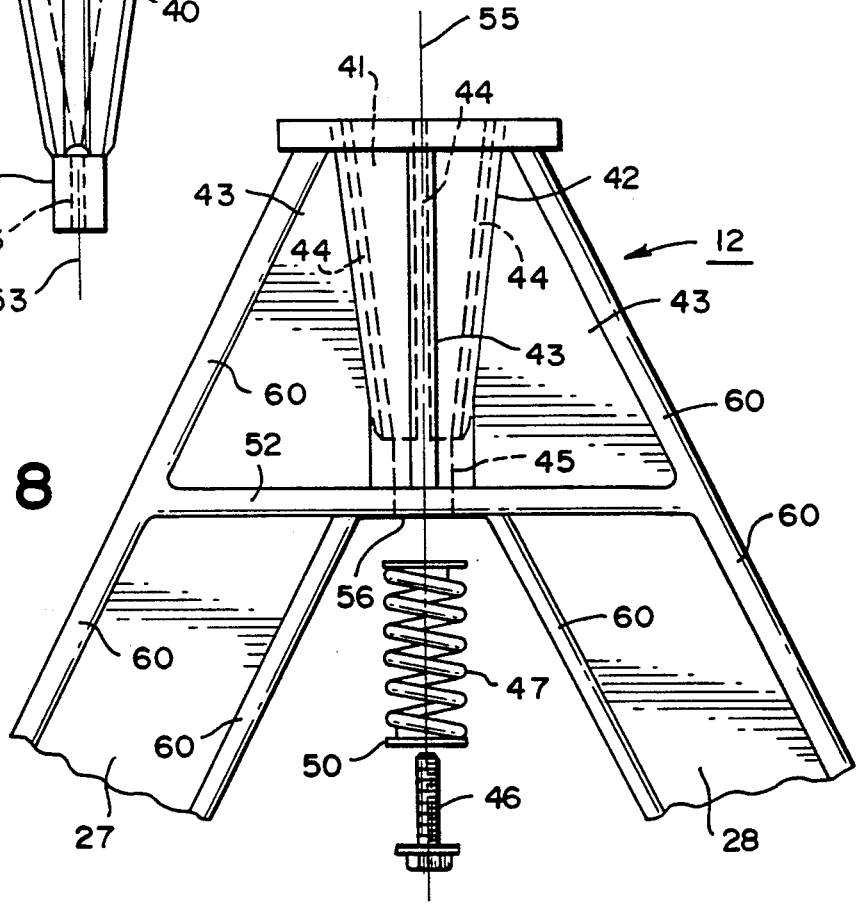
FIG. 8 is an enlarged fragmentary view of one leg assembly of the sawhorse showing the hollow shoe member and the biasing means of the swivel assembly.
Figure 14:
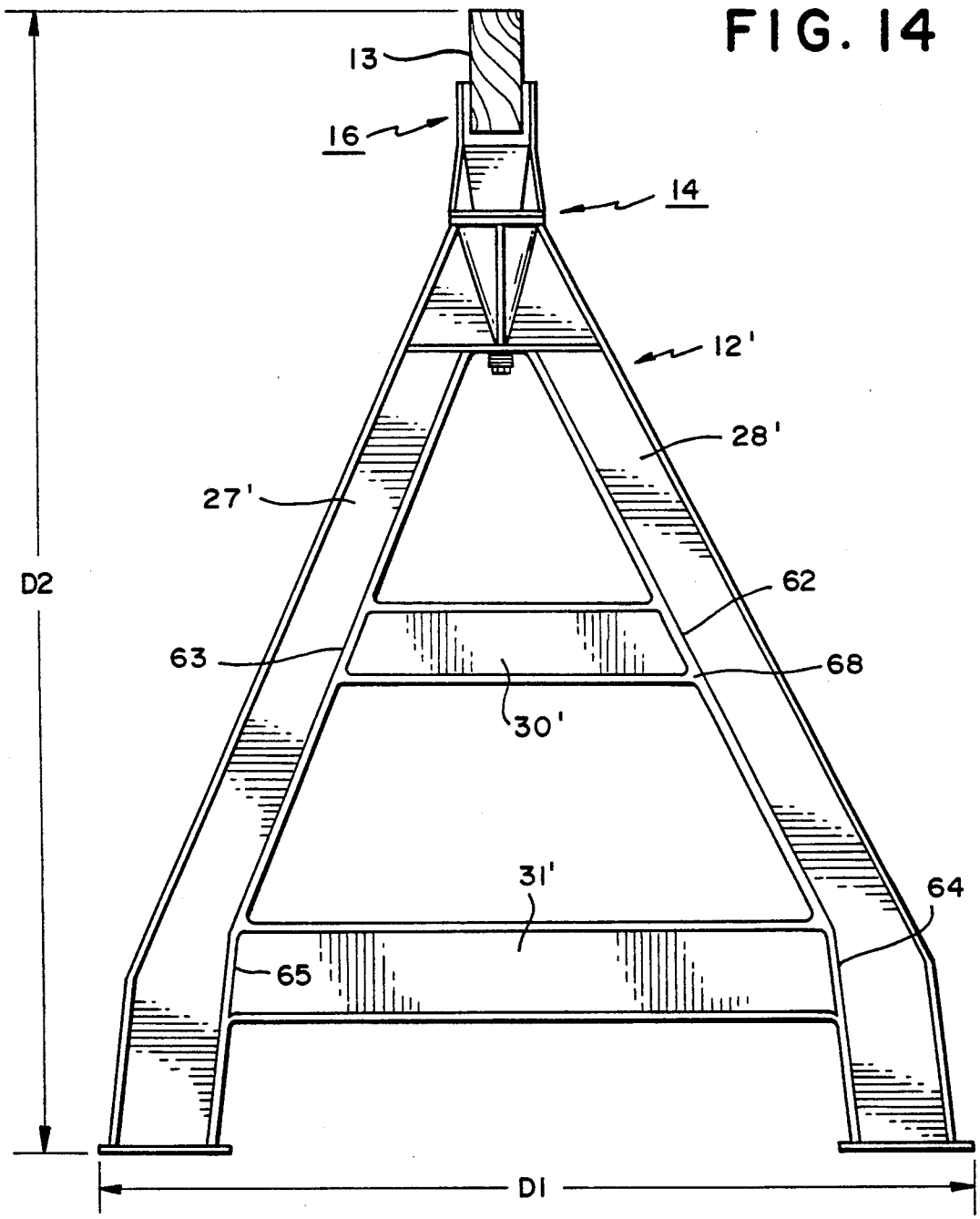

Also shown in FIG. 8 are molded edge flanges or webs 60 that provide an I-beam type cross section for increased rigidity and strength in the elongated runs of the struts 27 and 28 and the cross braces 30 and 31, as well as to the shoe portion 42 of the leg assembled. The struts and cross braces may be further reinforced with connecting together the edge flanges 60 by connecting flange segments 62, 63, 64 and 65, and by increasing the thickness of connecting junctures 68, as shown for the struts 27' and 28' and the cross braces 30' and 31' of the modified leg assembly 12' of FIG. 14. For this embodiment, the dimension D1 is preferably about 28.5 inches and the dimension D2 is preferably about 32 inches.

Figure 9:
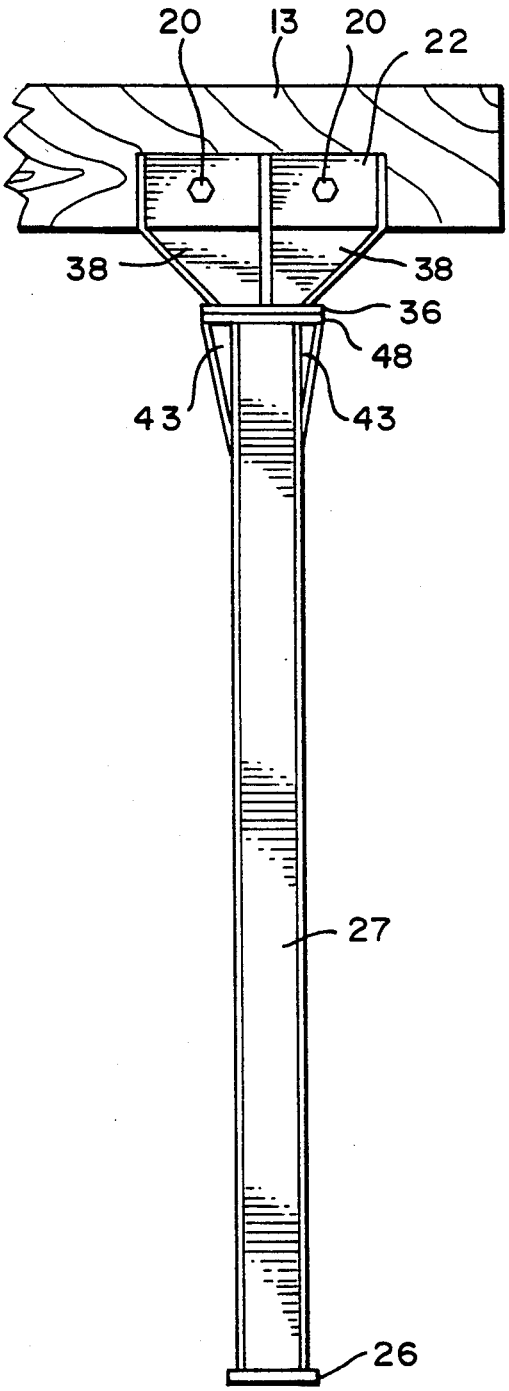
FIG. 9 is a side elevational view of one leg assembly of the sawhorse of the present invention in its support position.
Figure 10:
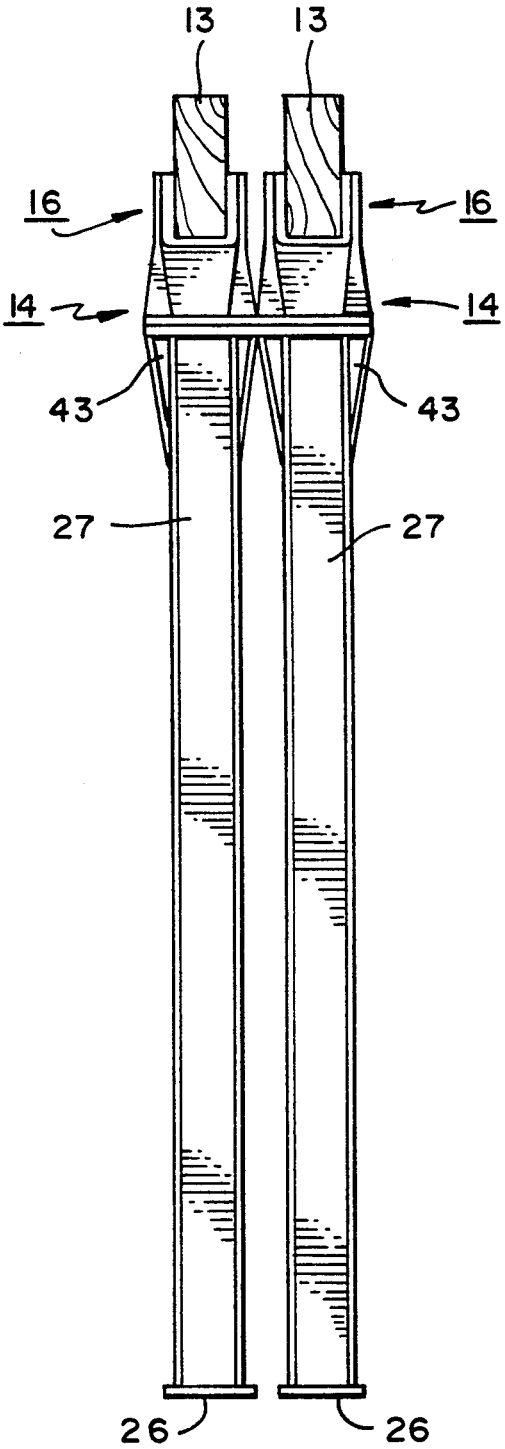
FIG. 10 is an end view in elevation showing a pair of sawhorses as they would appear in their folded and stored condition.

FIGS. 9 and 10 show the sawhorse of the present invention as it appears in its support condition (FIG. 9) and in its folded and stored condition (FIG. 10). FIG. 10 also illustrates the minimal space required by the present invention for storing a plurality of sawhorses in an upright position. The width of the sawhorse is no more than the diameter of the peripheral ridge 36 and deck 48. Although FIG. 10 shows two sawhorses as they would appear in a stored upright position, it is also possible to place the two sawhorses flat on the floor where they could be easily slid under a bench, bed, table or the like.

Figure 11:
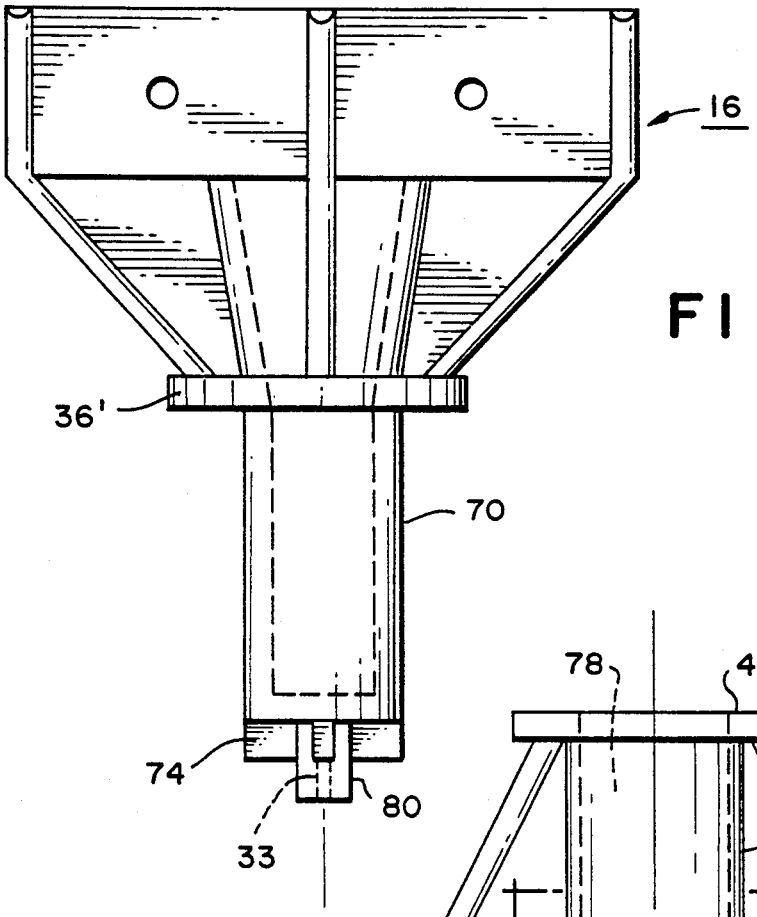
FIG. 11 is an enlarged view showing a modification of the foot member of the swivel assembly of the invention.
Figure 12:
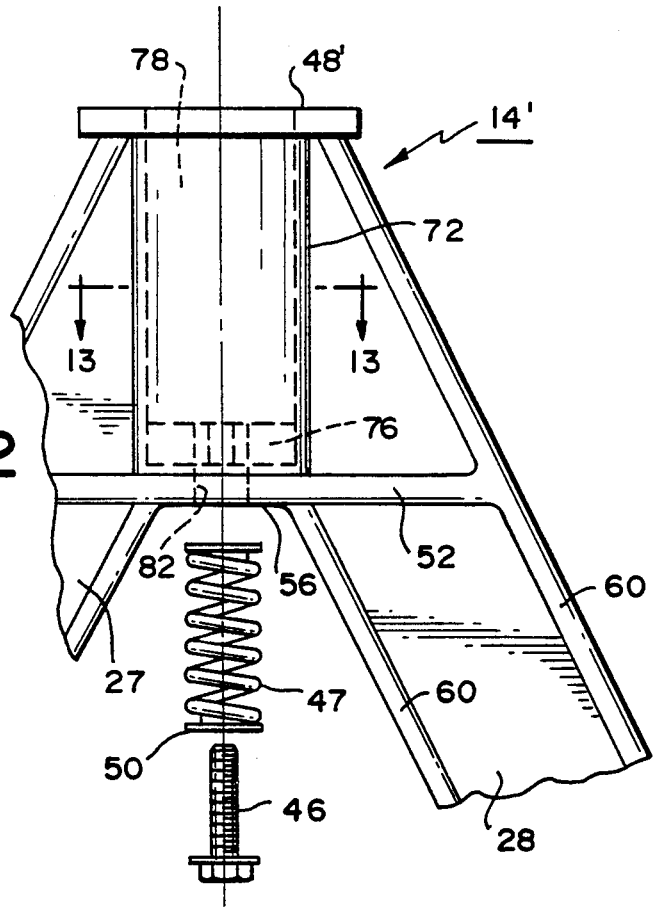
FIG. 12 is an enlarged fragmentary view showing a modification of the shoe member for cooperating with the foot member of FIG. 11.
Figure 13:
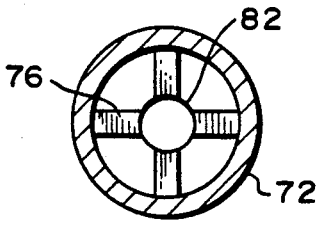
FIG. 13 is a sectional view taken along lines 13—13 of FIG. 12; and, FIG. 14 is an elevational end view showing a modification of the leg assembly of the invention.

Referring now to FIGS. 11–13, there is shown a modified swivel assembly 14' having a cylindrical foot 70 (instead of conical foot 30) and a cylindrical shoe 72 (instead of conical shoe 42). Foot 70 is provided at its lower end with elongated locking ridges, 74, which may be aligned with and received in elongated recesses 76 having a corresponding shape and located along the bottom of a cylindrical chamber 78 of shoe 72. Shoe 72 is preferably molded integrally with and connected to struts 27 and 28 and cross brace 52 in the same manner as shoe 30 of swivel assembly 14, with like parts having the same numerical designation. A cylindrical neck 80 at the lower end of foot 70 is sized and shaped to fit within and be guided by an aperture 82 also located at the bottom of shoe chamber 78. In the same manner as the embodiment of FIGS. 7 and 8, a peripheral ridge 36' of the foot 70 is biased into contact with a platform 48' of shoe 72 and the ridges 74 are retractable out of their interlocking relationship with recesses 76 when the shoe is moved axially against the tension of spring 47 for a distance sufficient for the ridges to be clear of the upper edges of the recesses within shoe chamber 78, but insufficient for neck 80 to be retracted out of guide aperture 82. As also shown in FIGS. 11–13, the profiles of ridges 74 correspond substantially to the contour of the bottom surface of chamber 78, such that the flat peak portions of the ridges may engage the flat bottom surface of the chamber during relative rotation between foot 70 and shoe 72. As a further embodiment of the invention (not shown), art is also possible to modify the lower end of foot 30 (FIG. 7) and the bottom of shoe chamber 41 (FIG. 8) to include ridges and recesses corresponding to the ridges 74 and recesses 76 of FIGS. 11 and 12, respectively.

As evident from the above, the invention is capable of many modifications by those skilled in the art. For example, the detents may extend along an interior surface of the shoe member and the recesses may extend along an exterior surface of the foot member, or both of these surfaces may have both detents and recesses with each recess arranged to receive an opposing detent or vice versa. Accordingly, the foregoing specific embodiments are for purposes of illustration and are not intended to limit the scope of the invention as defined by the appended claims.

What is claimed is:

1. A leg apparatus for connection to a beam to support a workpiece, said leg apparatus comprising:

leg means for extending downward and diverging from the beam to support the beam both horizontally and vertically on an underlying supporting surface when said leg means is connected to said beam and is in a support position transverse to said beam;

swivel means for rotatably connecting said leg means to said beam and comprising a first member, means for connecting said first member to said beam, and a second member connected to said leg means, said swivel means providing pivotal movement of said leg means between said support position where said leg means is transverse to said beam, and a folded position where the transverse extent of said leg means relative to said beam is substantially reduced; and, locking means for locking said leg means in at lest said support position, said locking means comprising biasing means for biasing said two members toward each other and into an interlocking position, said two members being nested one in the other, one of said members having at least one recess and the other having at least one projection which is received in said recess when said two members are in said interlocking position, and said biasing means permitting said two members to be drawn away from each other to retract said projection out of said recess for said pivotal movement.

2. The leg apparatus of claim 1 wherein the locking means has a second interlocking position defined by a second recess for receiving said projection; and wherein said biasing means permits said two members to be moved relative to each other so that said leg means may be pivoted from said support position to said folded position and locked in said folded position by said locking means.

3. The leg apparatus of claim 1, wherein said leg means further comprises at lest two vertically extending struts connected by at least two horizontally connecting cross members at least one of said cross members being adapted for use as a shelf.

4. The leg apparatus of claim 1, wherein one of said two members is a foot member and the other is a hollow shoe member defining a chamber, said foot member being adapted to be received and nested in the chamber of said hollow shoe member.

5. The leg apparatus of claim 4, wherein one of said two members has a plurality of projections spaced substantially equidistant around a surface portion thereof; wherein the other of said two members has a plurality of recesses adapted to receive said projections and spaced substantially equidistant around a corresponding surface portion of said other member, and wherein the surface portion of said one member and the surface portion of said other member engage each other when said projections are received in said recesses.

6. The leg apparatus of claim 4 wherein said swivel means further comprises:

a peripheral platform around a lip portion of said shoe member; and, a peripheral ridge around a portion of said foot member for resting on said platform when said two members are in said interlocking position.

7. The leg apparatus of claim 1, wherein said connecting means includes bracket means secured to said beam by at least one securing element passing through apertures in opposing sides of said bracket means, said opposing sides extending upwardly along opposite sides of said beam.

8. The leg apparatus of claim 1, wherein one of the members of said swivel means is an integral portion of said leg means.

9. The leg apparatus of claim 1, wherein said biasing means comprises a spring secured to a portion of one of said two members, and means for compressing said spring against a portion of the other of said two members.

10. The leg apparatus of claim 4, wherein said foot member has a cylindrical neck portion for extending into an aperture in a bottom portion of the chamber of said hollow shoe member, wherein said biasing means comprises a fastening means for engaging said neck portion to secure said shoe member to said foot member, and wherein the length of said neck portion is such that a substantial part of said neck portion may remain in said aperture to guide said shoe member when said projection is retracted out of said recess.

11. The leg apparatus of claim 4, wherein an exterior portion of said foot member and an interior portion of said shoe member both define conical surfaces which are tapered by substantially equal amounts, and wherein said projection is elongated and extends along the conical surface of one of said members and said recess is elongated and extends along the conical surface of the other of said members.

12. The leg apparatus of claim 4, wherein an exterior portion of said foot member and an interior portion of said shoe member both define cylindrical surfaces, and wherein said projection is on a bottom surface of one of said members and said recess is in a bottom surface of the other of said members.

13. The leg apparatus of claim 1 wherein one of said two members has a plurality of elongated ridges spaced substantially equidistant around a surface portion thereof; wherein the contour of said two members has a plurality of elongated recesses adapted to receive said projections and spaced substantially equidistant around a corresponding surface portion thereof, and wherein the profile of said ridges corresponds substantially to the contour of said surface portion of said other member such that peak positions of said ridges may engage said the member surface portion when said projections are not in said recesses.

14. A leg apparatus for connection to a beam to support a workpiece, said leg apparatus comprising:

leg means for extending downward and diverging from the beam to support the beam both horizontally and vertically on an underlying supporting surface when said leg means is connected to said beam and is in a support position transverse to said beam;

swivel means for rotatably connecting said leg means to said beam and comprising a first member, means for connecting said first member to said beam, and a second member connected to said leg means, said swivel means providing pivotal movement of the leg means between said support position where said leg means is transverse to said beam, and a folded position where the transverse extent of said leg means relative to said beam is substantially educed; and, locking means for locking said leg means in at least said support position, said two members being nested one in the other, one of said members having at least one recess and the other having at least one projection which is received in said recess when said two members are in an interlocking position, and said locking means providing selective retraction of said projection out of said recess for said pivotal movement;

wherein said connecting means comprises bracket means and at least one securing element for securing said bracket means to said beam;

wherein said bracket means comprises opposing sidewalls for extending along opposite sides of said beam, and a base portion which connects said sidewalls;

wherein one of said members is mounted on the underside of said base portion;

and wherein said securing element is adapted to pass through apertures in the opposing sidewalls of said bracket means.

15. A swivel apparatus for rotatably connecting together a first component and a second component, said apparatus comprising:

swivel means for providing pivotal movement of said first component between at least a first position and a second position relative to said second component, said swivel means comprising a hollow shoe member defining a chamber, means for connecting said shoe member to one of said components, a foot member adapted to be received and nested in said chamber of the hollow shoe member, and means for connecting said foot member to the other of said components; and, locking means for locking said first component in at least one of said first and second positions, said locking means comprising biasing means for biasing said two members toward each other and into at least one interlocking position when said foot member is nested in said shoe member, one of said members having at least one recess and the other having at least one projection which is received in said recess when said two members are in said interlocking position, and said biasing means permitting said two members to be drawn away from each other to retract said projection out of said recess for said pivotal movement.

16. The swivel apparatus of claim 15 wherein the locking means has a second interlocking position defined by a second recess for receiving said projection, and wherein said biasing means permits said two members to be move relative to each other so that said first component may be pivoted between said first position and said second position and locked in either of said first and second positions by said locking means.

17. The swivel apparatus of claim 15, wherein one of said two members has a plurality of projections spaced substantially equidistant around a surface portion thereof, wherein the other of said two members has a plurality of recesses adapted to receive said projections and spaced substantially equidistant around a corresponding surface portion thereof, and wherein the surface portion of said one member and the surface portion of said other member engage each other when said projections are received in said recesses.

18. The swivel apparatus of claim 15, wherein said swivel means further comprises:

a peripheral platform around a lip portion of said shoe member; and, a peripheral ridge around a portion of said foot member for resting on said platform when said two members are in said interlocking position.

19. The swivel apparatus of claim 15, wherein said biasing means comprises a spring secured to a portion of one of said two members, and means for compressing said spring against a portion of the other of said two members.

20. The swivel apparatus of claim 15, wherein said foot member has a cylindrical neck portion for extending into an aperture in a bottom portion of the chamber of said hollow shoe member, wherein said biasing means comprises a fastening means for engaging said neck portion to secure said shoe member to said foot member, and wherein the length of said neck portion is such that a substantial part of said neck portion may remain in said aperture to guide said shoe member when said projection is retracted out of said recess.

21. The swivel apparatus of claim 15, wherein an exterior portion of said foot member and an interior portion of said shoe member both define conical surfaces which are tapered by substantially equal amounts, and wherein said projection is elongated and extends along the conical surface of one of said members and said recess is elongated and extends along the conical surface of the other of said members.

22. The swivel apparatus of claim 15, wherein an exterior portion of said foot member and an interior portion of said shoe member both define cylindrical surfaces, and wherein said projection is on a bottom surface of one of said members and said recess is in a bottom surface of the other of said members.

23. The swivel apparatus of claim 15, wherein one of said two members has a plurality of elongated ridges spaced substantially equidistant around a surface portion thereof; wherein the other of said two members has a plurality of elongated recesses adapted to receive said projections and spaced substantially equidistant around a corresponding surface portion thereof, and wherein the profile of said ridges corresponds substantially to the contour of said surface portion of said other member such that peak positions of said ridges may engage said other member surface portion when said projections are not in said recesses.

* * * * *

UNITED STATES PATENT AND TRADEMARK OFFICE

CERTIFICATE OF CORRECTION

PATENT NO. : 5,184,697

DATED : February 9, 1993

INVENTOR(S) : Crewe, et. al.

It is certified that error appears in the above-indentified patent and that said Letters Patent is hereby corrected as shown below:

Column 6, line 15, change "lest" to --least--;
line 36, change "lest" to --least--;

Column 7, line 36, change "contour" to --other--;

line 43, change "the" to --other--; and line 61, change "educed" to --reduced--.

Column 8, line 46, change "move" to --moved--.

Signed and Sealed this

Twenty-first Day of December, 1993

Bruce Lehman

*Attest:*

BRUCE LEHMAN

*Attesting Officer*

*Commissioner of Patents and Trademarks*